United States Patent [19]

Imaizumi

[11] Patent Number: 4,593,993

[45] Date of Patent: Jun. 10, 1986

[54] DEVICE FOR MOVING SEPARATING BELT INTO OR OUT OF CONTACT WITH PHOTOCONDUCTIVE DRUM IN ELECTROPHOTOGRAPHIC COPYING MACHINE

[75] Inventor: Masaru Imaizumi, Shinshiro, Japan

[73] Assignee: Minolta Camera Kabushiki Kaisha, Osaka, Japan

[21] Appl. No.: 706,607

[22] Filed: Feb. 28, 1985

[30] Foreign Application Priority Data

Mar. 2, 1984 [JP] Japan ..... 59-40838

[51] Int. Cl.[4] ..... G03G 15/00; B65H 29/54

[52] U.S. Cl. ..... 355/3 R; 355/3 SH; 271/306

[58] Field of Search ..... 355/3 R, 3 SH, 3 TR, 355/14 SH, 14 TR; 271/306–313, 900

[56] References Cited

U.S. PATENT DOCUMENTS 3,985,436 10/1976 Tanaka et al. ..... 355/8
4,179,116 12/1979 Umezawa et al. ..... 271/306

FOREIGN PATENT DOCUMENTS 0077768 6/1980 Japan ..... 271/308
58-25651 2/1983 Japan .
58-144363 9/1983 Japan .

*Primary Examiner*—Arthur T. Grimley
*Assistant Examiner*—C. Romano
*Attorney, Agent, or Firm*—Wenderoth, Lind & Ponack

[57] ABSTRACT

In an electrophotographic copying machine wherein a photoconductive drum and at least one of the image forming elements, such as developing unit and cleaner, arranged around the drum are assembled into a unit which is removable from and fittable into the machine main body axially of the drum, the machine having a separating belt being provided on the lower frame of the main body, and a device for moving the separating belt into or out of contact with the drum, the device including a lever member supporting the separating belt and permitting the separating belt to move into or out of contact with the drum, and a cam member attached to the unit, which engages with said lever member so as to move the separating belt out of contact with the drum in operative relation with the movement of the unit when the unit is withdrawn and installed.

5 Claims, 7 Drawing Figures

DEVICE FOR MOVING SEPARATING BELT INTO OR OUT OF CONTACT WITH PHOTOCONDUCTIVE DRUM IN ELECTROPHOTOGRAPHIC COPYING MACHINE

BACKGROUND OF THE INVENTION

The present invention relates to a device for moving a separating belt into or out of contact with the photoconductive drum of an electrophotographic copying machine wherein the photoconductive drum and at least one of the image forming, elements, such as the developing unit and cleaner, arranged around the drum are assembled into a unit which is removable from and fittable into the machine main body axially of the drum.

Electrophotographic copying machines are known which include a separating belt as means for separating copy paper from the photoconductive drum after the transfer of image and in which some of the image forming elements around the drum are assembled into a unit which is removably installed in the main body of the copying machine. With this type of copying machines, the separating belt, which is in pressing contact with one end portion of the photoconductive drum, is generally provided on the machine main body. When the drum unit is removed or re-installed with the separating belt of this arrangement held in pressing contact with the drum, the rear wall of the drum unit and a gear and the like attached to the rear end of the drum cause damage to the separating belt, which also causes damage to the drum by sliding contact therewith. Accordingly a device must be provided for moving the separating belt into or out of contact with the drum.

As disclosed, for example, in Published Unexamined Japanese Patent Application No. SHO 58-25651, etc., such a device is conventionally adapted to be operated independently, and therefore needs to be manipulated every time the drum unit is to be removed or fitted in place, and is cumbersome to handle.

SUMMARY OF THE INVENTION

An object of the present invention is to provide a device for moving a separating belt into or out of contact with the photoconductive drum of a copying machine of the type described which device is smoothly operable to bring the separating belt into or out of contact with the drum by a single snap-in/snap-out movement of the drum unit without the necessity for the user to manipulate the device when the drum unit is to be installed or removed.

More specifically, for use in an electrophotographic copying machine wherein the photoconductive drum and at least one image forming element around the drum are assembled into a unit which is removable from and installable into the main body of the machine axially of the drum, the present invention provides a device for moving a separating belt into or out of contact with the photoconductive drum, the separating belt being provided on the lower frame of the main body, the device comprising a lever member supporting the separating belt and permitting the separating belt to move into or out of contact with the drum, and a cam member attached to the unit, the lever member being engageable with the cam member so as to move the separating belt out of contact with the drum in operative relation with the movement of the unit when the unit is withdrawn and installed.

A structural feature of the present device is that the lever member, which supports one end of the separating belt, is pivotably supported on a pivot mounted on the lower frame of the main body and is biased at all times into contact with a stopper in a direction to tension the separating belt, the other end of the separating belt being supported by an elastic member on the main body lower frame. The force of the elastic member pulling the other end of the belt needs to be small so as not to prevent the contact of the lever member with the stopper.

Another structural feature of the present device is that the lever member, which supports one end of the separating belt, is so supported as to be slidable away from the photoconductive drum along guide members mounted on the main body lower frame and is so biased at all times as to be in a position most proximate to the drum, the other end of the separating belt being supported by an elastic member on the main body lower frame. The force of the elastic member pulling the other end of the belt needs to be small so as not to displace the lever member from the position most proximate to the drum.

Another structural feature of the present device is that the lever member, which supports one end of the separating belt, is supported by guide members mounted on the main body lower frame so as to be slidable in the direction of an involute extending from the outer periphery of the drum, the lever member being biased at all times so as to be in a position most proximate to the drum.

On the other hand, the position and length of the cam included in the present device are so determined that the separating belt is held out of contact with the photoconductive drum while at least the portion of the unit from its rear wall to the rear end face of the drum passes over the separating belt.

DETAILED DESCRIPTION OF THE INVENTION

Figure 1:
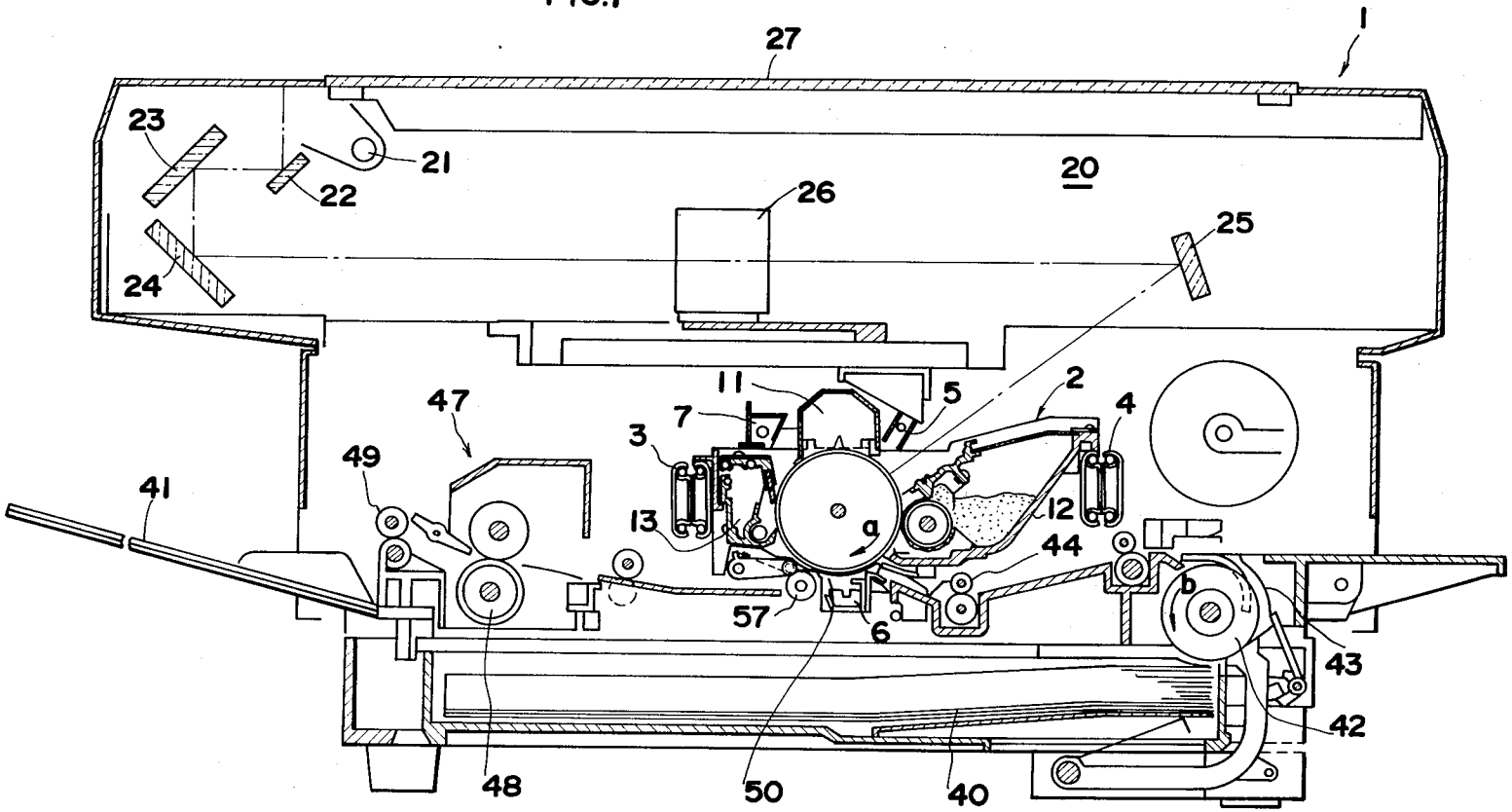
FIG. 1 a front view in section showing the overall construction of an electrophotographic copying machine which is provided with a device of the present invention for moving a separating belt into or out of contact with the photoconductive drum of the machine.

FIG. 1 shows the overall construction of an electrophotographic copying machine provided with a device of the invention for a separating belt.

The main body 1 of the copying machine has approximately in its center a photoconductive drum 10 which is rotatable in the direction of arrow a. Arranged around the drum 10 along the direction of rotation are a sensitizing charger 11, side eraser 5, magnetic brush developing unit 12, transfer charger 6, separating belt 50, separating roller 57, blade cleaner 13 and eraser lamp 7. Of these image forming elements, the sensitizing charger 11, the developing unit 12 and the cleaner 13 are assembled into a drum unit 2, which is removable along slide rails 3 and 4 toward the front (i.e. toward the viewer of the drawing).

An optical system 20 comprises a light source 21, mirrors 22, 23, 24, 25 and a lens 26. The light source 21 and the mirror 22 move at a speed v, and the mirrors 23, 24 travel at a speed v/2, whereby an original on a glass plate 27 is continuously scanned. An optical image of the original is projected on the drum 10 charged to a predetermined potential by the sensitizing charger 11 and rotating in the direction of arrow a. The latent image formed is then developed by the developing unit 12 to a toner image, which is thereafter brought to a transfer station.

A detachable paper cassette 40 has accommodated therein sheets of copy paper which are sent out one by one by the rotation of a feed roller 42 in the direction of arrow b. The copy paper sent out is turned upside down by a guide plate 43 and transported to the transfer station by a pair of timing rollers 44 for adjusting the timing of transport of the copy paper to register at the transfer station the leading end of the paper with the forward end of the toner image formed on the drum 10. At the transfer station, the toner image is transferred to the copy paper by the discharge of the transfer charger 6, and the image bearing paper is separated from the surface of the drum 10 by the separating belt 50 and the separating roller 57 to be described below in detail. The paper is further passed between a pair of fixing rollers 48 within a fixing unit 47, whereby the toner image is fused and fixed to the paper. The paper is then delivered onto a tray 41 by a pair of discharge rollers 49.

The drum 10 further continues to rotate in the direction of arrow a after the transfer of image, permitting the cleaner 13 to remove the remaining toner and the lamp 7 to erase the residual charge with its light. Thus, the drum 10 is made ready for the next copying cycle.

Next, the device of the invention for moving the separating belt 50 into or out of contact with the drum 10 will be described. Also described is the snap-in/snap-out movement of the drum unit 2 which is in operative relation with the device.

Figure 2:
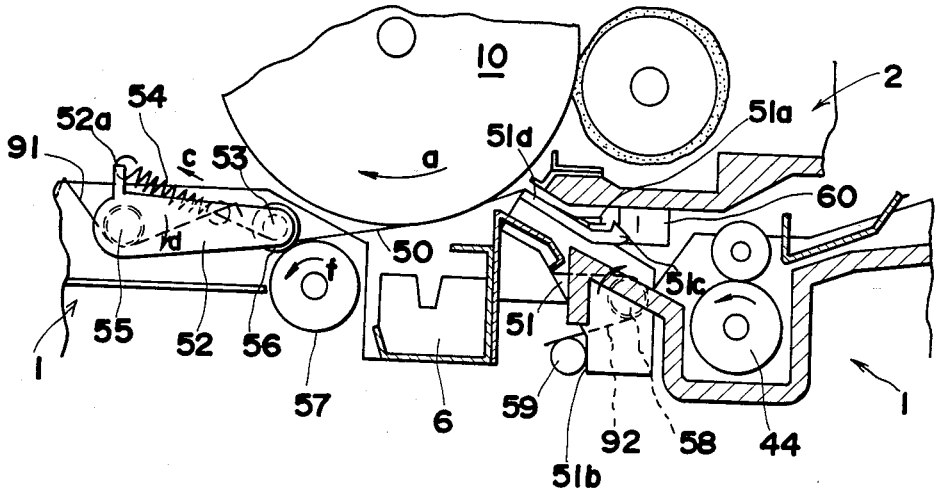
FIG. 2 is a diagram schematically showing the construction of the device of FIG. 1.
Figure 3:
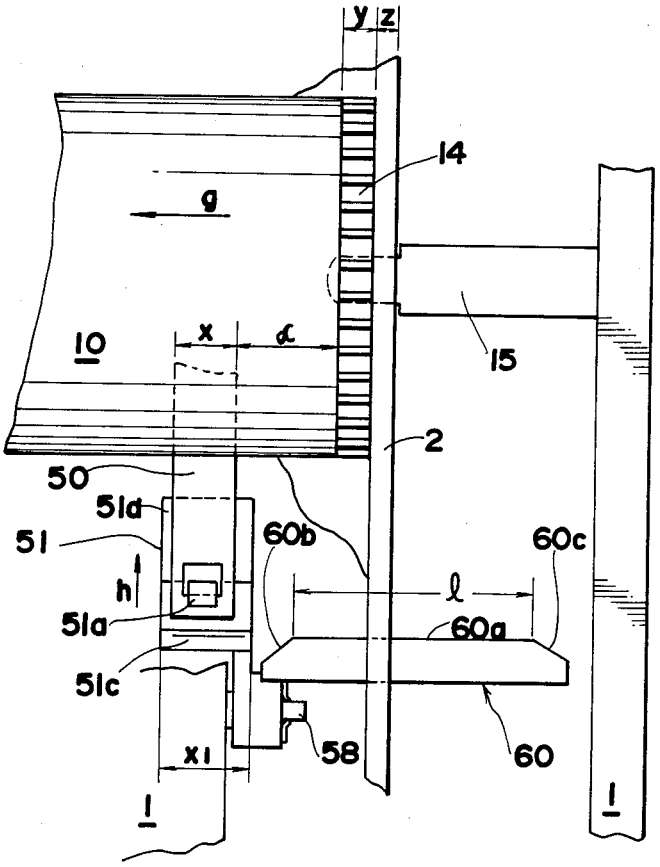
FIG. 3 is a fragmentary plan view of the device shown in FIG. 2.

As shown in FIGS. 2 and 3, the separating belt 50 has one end attached to a lug 51*a* of a lever 51 and the other end passed around a pin 53 on the forward end of an arm 52 and biased by a belt spring 54 in the direction of arrow c at all times. The other end of the belt spring 54 is engaged with a projection 52*a* on the arm 52. The arm 52 is mounted rotatably on the main body 1 by a pivot 55 and is provided at its forward end with a pressure roller 56 rotatably mounted on the pin 53. The arm 52 is biased by a spring 91 in the direction of arrow d at all times to hold the pressure roller 56 in contact with the upper side of the separating roller 57, whereby the arm 52 is positioned in place.

The lever 51 is pivotably mounted on a pivot 58 fixed to the main body 1 and is biased by a spring 92 in the direction of arrow e at all times, with a lever end portion 51*b* bearing against a stopper 59, whereby the lever 51 is positioned in place.

The photoconductive drum 10 has a gear 14 at its rear end and is held in position within the drum unit 2 by a rod 15 fixed to the main body 1.

Figure 5:
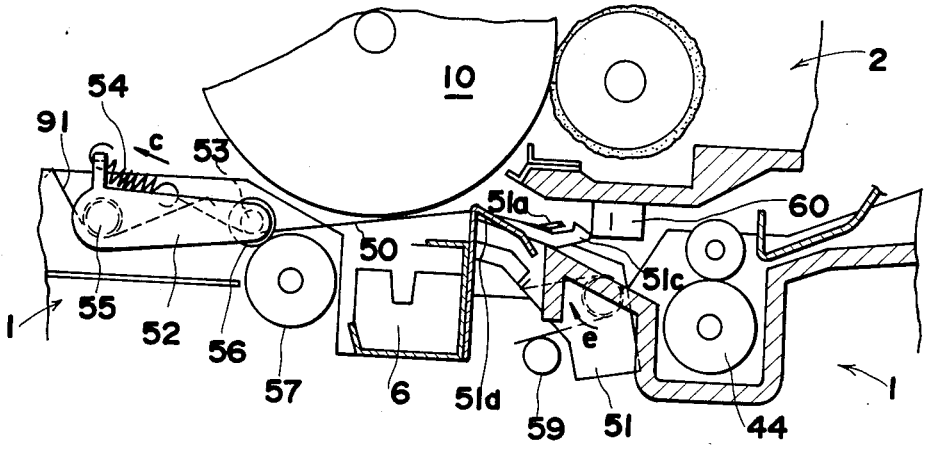
FIG. 5 is a diagram for illustrating the operation of the device.

Accordingly, the separating belt 50 is held in pressing contact with a rear end portion of the drum 10 from below in the state shown in FIGS. 2 and 3. The copy paper is transported, at its one side portion, on the separating belt 50, nipped between the separating roller 57 and the pressure roller 56, separated from the drum surface and sent toward the fixing unit 47 by the rotation of the separating roller 57 in the direction of arrow f. If the drum unit 2 is removed or installed with the separating belt 50 in pressing contact with the drum 10, the belt 50 or the drum 10 becomes damaged as already mentioned. This drawback must be avoided by moving the separating belt 50 away from the drum 10 downward as seen in FIG. 5 when the drum unit 2 is removed from or installed into the main body 1.

Figure 4:
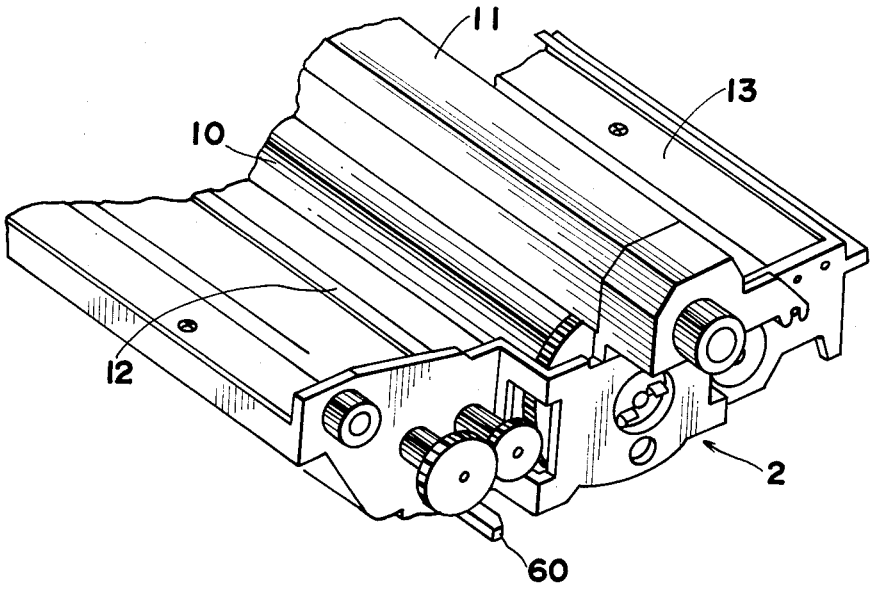
FIG. 4 is a perspective view of a drum unit as it is seen from the rear.

FIG. 4 shows that the drum unit 2 is fixedly provided at the bottom of its rear end with a cam 60 which, as seen in FIG. 3, is so positioned as to be slidable in contact with a pawl portion 51*c* of the lever 51 and is disposed in close proximity to the lever 51. The cam 60 is elongated axially of the drum 10 and has a flat face 60*a* for sliding contact with the pawl portion 51*c* of the lever 51 and slanting faces 60*b*, 60*c* at opposite sides of the flat face 60*a*. The length l of the flat face 60*a* determines the period of separation or retraction of the separating belt 50 from the drum 10. Suppose the separating belt 50 has a width x, the pawl portion 51*c* has a width $x_1$, the gear 14 has a thickness y, the rear wall of the drum unit 2 has a thickness z, and the distance between the belt 50 and the gear 14 is $\alpha$. It is then required that the length l be not smaller than $x+y+z-x_1+\alpha$. According to the present invention, the length l of the flat face 60*a* is determined in view of the foregoing arrangement. If the pawl portion 51*c* of the lever 51 is pointed for the cam 60 to contact therewith at a point, $x_1$ is to be omitted from the above relation. Further if the separating belt 50 is adapted to contact the drum 10 at the utmost rear end thereof, $\alpha$ is omitted from the above relation.

The engaging relation between the lever 51 and the cam 60, as well as the operative relation between the separating belt 50 and the drum unit 2, will now be described.

When the drum unit 2 is withdrawn from the main body 1 toward the front, i.e. in the direction of arrow g in FIG. 3, the cam 60 comes into contact with the pawl portion 51*c* of the lever 51 approximately simultaneously with the start of its movement, permitting the pawl portion 51*c* to come into sliding contact with the slanting face 60*b* of the cam 60 and then with the flat face 60*a* thereof, and thereby moving the pawl portion in the direction of arrow h. With this movement, the lever 51 rotates in the direction opposite to the arrow e with the forward end 51*d* of the lever lowered to lower one end of the separating belt 50 as shown in FIG. 5. Consequently, the belt 50 is brought out of contact with the drum 10. As the drum unit 2 is further withdrawn, the pawl portion 51*c* comes into contact with the slanting face 60*c* and is thereafter released from the cam 60, whereupon the lever 51 rotates in the direction of arrow e and raises the belt 50. By this time, however, the rear end of the drum 10 has already passed over the separating belt 50, so that there is no likelihood of one causing damage to the other.

Subsequently, when the drum unit 2 is installed into the main body 1, the cam 60 comes into contact with the pawl portion 51*c*, permitting the pawl portion 51*c* to come into sliding contact with the slanting face 60*c* first and then with the flat face 60*a*, whereby the pawl portion is moved in the direction of arrow h. As in the case of withdrawal, therefore, the lever 51 rotates to lower the separating belt 50. The drum unit 2 is thereafter installed in position, whereupon the pawl portion 51*c* of the lever 51 moves in the direction opposite to the arrow h, thereby bringing the separating belt 50 into pressing contact with the drum 10.

Figure 6:
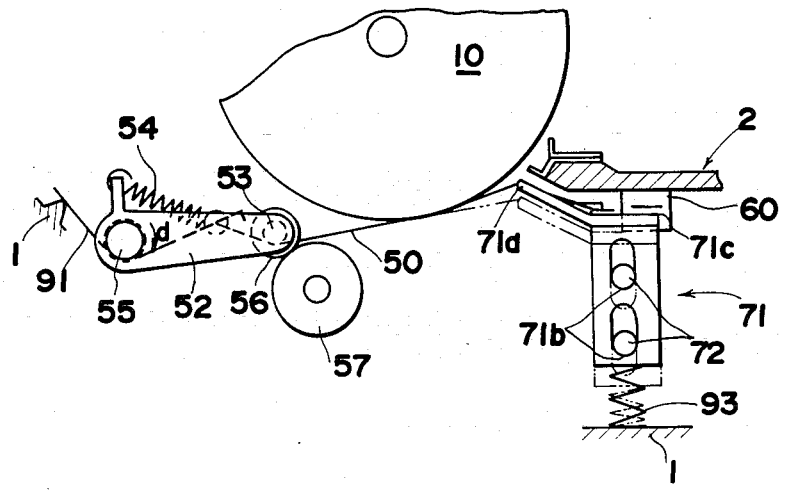
FIG. 6 is a diagram schematically showing the construction of a second embodiment of the invention.

The present invention is not limited to the foregoing embodiment but may be embodied as shown in FIG. 6. It is seen that a lever 71 is slidable upward and downward.

The lever 71 is vertically slidably mounted on the main body 1 by means of two slots and two pins 72, biased upward by a spring 93 and positioned in place by the contact of the pins 72 with slotted bottom portions 71*b* of the lever. The construction of the second embodiment other than the above feature is the same as that of the first embodiment and therefore will not be further described. This embodiment operates substantially in the same manner as the foregoing embodiment. The sliding contact of the top portion 71*c* of the lever with a cam 60 lowers the lever 71, moving the separating belt 50 out of contact with the photoconductive drum 10.

Figure 7:
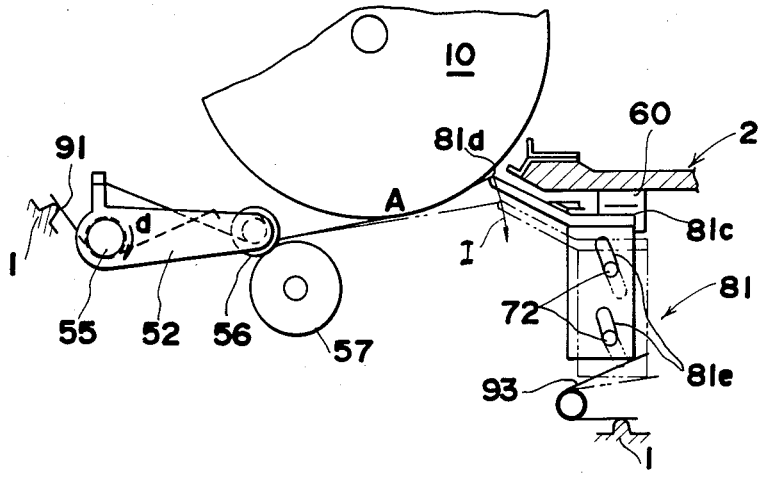
FIG. 7 is a diagram schematically showing the construction of a modification of the second embodiment.

FIG. 7 shows a lever 81 which is slidable upward and downward. Slots 81*e* are so shaped that the forward end 81*d* of the lever 81 traces an involute I with respect to the ultimate point of contact, A, between the separating belt 50 and the drum 10. Since the length of the belt 50 from the contact point A to the forward end 81*d* remains unchanged in this case, the belt spring can be dispensed with.

What is claimed is:

1. In an electrophotographic copying machine wherein a photoconductive drum and at least one image forming element arranged around said drum are assembled into an unit which is removable from and installable into the main body of said machine axially of said drum, said machine having a separating belt being provided on the lower frame of the main body, and a device for moving said separating belt into or out of contact with said drum, said device comprising a lever member supporting said separating belt and permitting said separating belt to move into or out of contact with said drum, and a cam member attached to said unit which engages with said lever member so as to move said separating belt out of contact with said drum in operative relation with the movement of said unit when said unit is withdrawn and installed.

2. A device as claimed in claim 1, wherein said lever member supports one end of said separating belt and is pivotably supported on a pivot mounted on the lower frame of the main body and is biased at all times toward a stopper in a direction to tension said separating belt, the other end of said separating belt being supported by an elastic member on said main body lower frame with the force of said elastic member pulling the other end of said belt being sufficiently small so as not to prevent the contact of said lever member with said stopper.

3. A device as claimed in claim 1, wherein said lever member supports one end of said separating belt and is so supported as to be slidable away from said photoconductive drum along guide members mounted on the lower frame on the main body and is biased at all times toward a position most proximate to said drum, the other end of said separating belt being supported by an elastic member on said main body lower frame with the force of said elastic member pulling the other end of said belt being sufficiently small so as not to displace said lever member from the position most proximate to said drum.

4. A device as claimed in claim 1, wherein said lever member supports one end of said separating belt and is supported by guide members mounted on the lower frame on the main body so as to be slidable in the direction of an involute extending from the outer periphery of said drum, said lever member is biased at all times toward a position most proximate to said drum.

5. A device as claimed in claim 1, wherein the position and length of said cam are so determined that said separating belt is held out of contact with said photoconductive drum while at least the portion of said unit from its rear wall to the rear end face of said drum passes over said separating belt.

* * * * *